US008092238B2

(12) United States Patent
Sun

(10) Patent No.: US 8,092,238 B2
(45) Date of Patent: Jan. 10, 2012

(54) UNIVERSAL SERIAL BUS INTERFACE

(75) Inventor: Zheng-Heng Sun, Tu-Cheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 79 days.

(21) Appl. No.: 12/827,009

(22) Filed: Jun. 30, 2010

(65) Prior Publication Data

US 2011/0281473 A1 Nov. 17, 2011

(30) Foreign Application Priority Data

May 14, 2010 (CN) ..... 2010 1 0172769

(51) Int. Cl.
*H01R 13/44* (2006.01)

(52) U.S. Cl. ..... 439/131; 439/142

(58) Field of Classification Search ..... 439/131, 439/142

See application file for complete search history.

(56) References Cited

U.S. PATENT DOCUMENTS 7,125,267 B1 * 10/2006 Yeh ..... 439/131
7,160,137 B1 * 1/2007 Yeh ..... 439/358
7,361,032 B2 * 4/2008 Loftus ..... 439/131
7,473,112 B2 * 1/2009 Zhu et al. ..... 439/142
7,740,494 B2 * 6/2010 Lin et al. ..... 439/131
7,787,243 B2 * 8/2010 Salazar et al. ..... 361/679.31
7,869,219 B2 * 1/2011 Ma et al. ..... 361/737

* cited by examiner

*Primary Examiner* — Truc Nguyen
(74) *Attorney, Agent, or Firm* — Altis Law Group, Inc.

(57) ABSTRACT

A universal serial bus (USB) interface includes a positive differential signal pin including first and second sections, a button mounted to the USB interface, and an elastic piece. The button includes a driving rod with a distal end resisting against the second section, a receiving room is defined below the second section to receive the elastic piece, so the second section is clamped between the elastic piece and the driving rod and is electrically connected to the first section. When the button is pressed, the driving rod of the button causes the second section to deform the elastic piece, so the second section moves away from the first section. When the button is released, the elastic piece is restored to return the first section to the second section, so the first and second sections are electrically connected again.

12 Claims, 8 Drawing Sheets

UNIVERSAL SERIAL BUS INTERFACE

BACKGROUND

1. Technical Field

The present disclosure relates to universal serial bus (USB) interfaces, more particularly to a USB interface capable of reducing hot swap frequency between two electronic devices.

2. Description of Related Art

A USB cable is usually used to connect a peripheral device, such as a storage device, to a computer. When a user no longer needs to read or write to the peripheral device, the user may use the operating system of the computer to "eject" the peripheral device to sever the connection between the computer and the peripheral device, enabling the peripheral device to be physically removed from a USB port. The peripheral device may not be physically removed from the computer but is still shown as not being connected or is ignored by the operating system. If the operating system needs to access the peripheral device again, the peripheral device must be physically disconnected from the computer and then reconnected to the computer.

Moreover, the peripheral device may not be detected by the computer when a USB interface of the USB cable connected to the peripheral device is initially hot plugged in the computer, so the USB interface must be unplugged from the computer and then plugged in again to the computer perhaps several times, until the peripheral device is detected by the computer. Repeated insertion and removal of the USB interfaces of the USB cable for frequent use may wear out the USB interfaces of the computer and the peripheral device quickly.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The disclosure, including the accompanying drawings in which like references indicate similar elements, is illustrated by way of examples and not by way of limitation. It should be noted that references to "an" or "one" embodiment in this disclosure are not necessarily to the same embodiment, and such references mean at least one.

Figure 1:
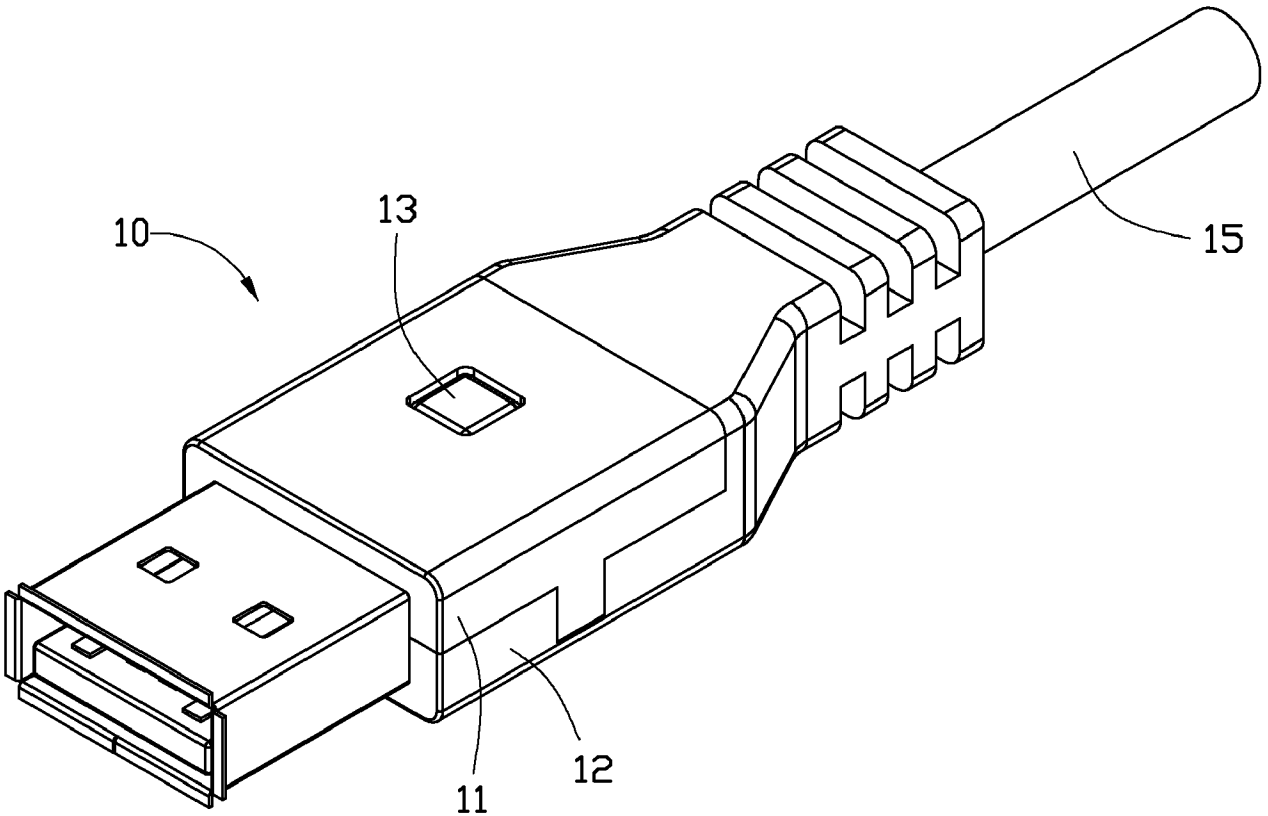
FIG. 1 is an isometric view of a first embodiment of a universal serial bus (USB) interface.
Figure 2:
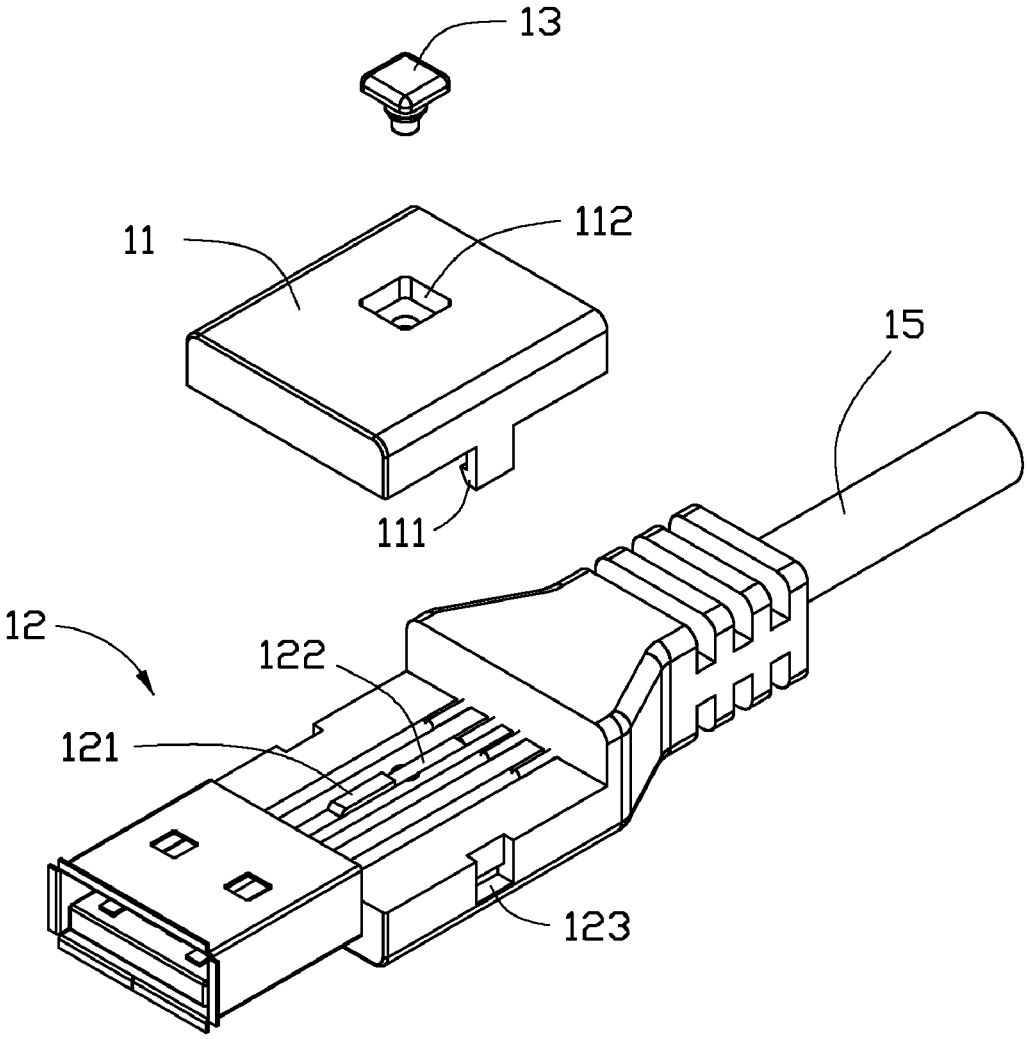
FIG. 2 is a partially exploded, isometric view of the USB interface of FIG. 1.
Figure 3:
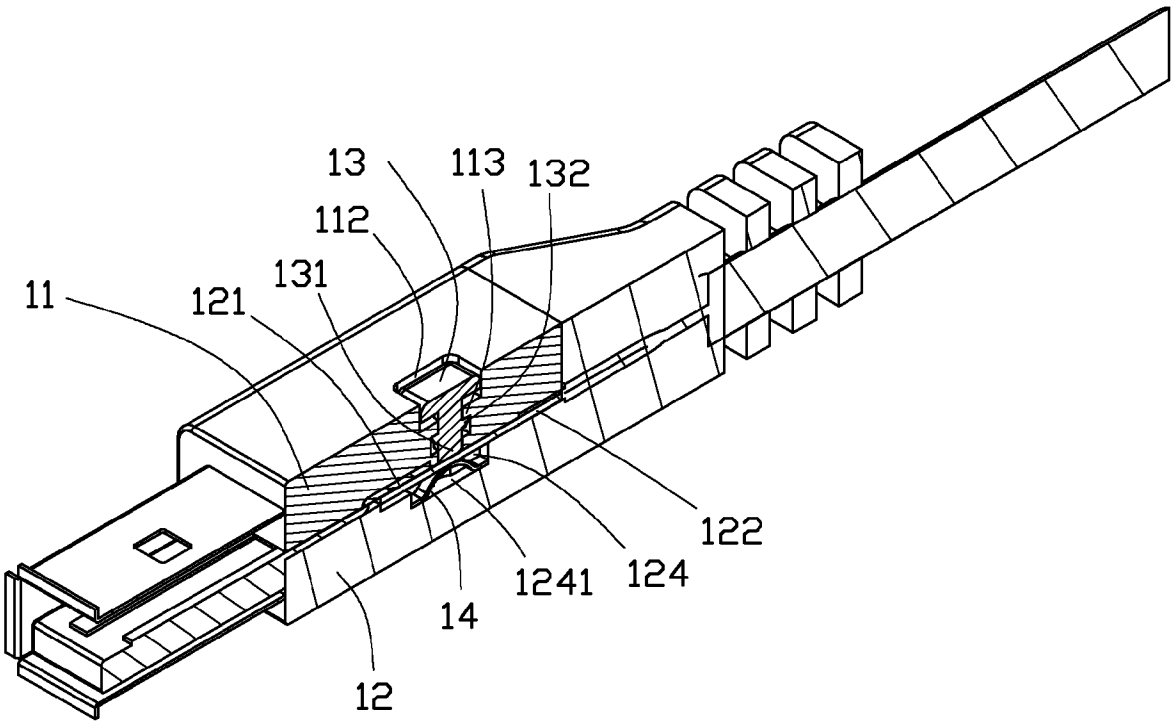
FIG. 3 is a cross-sectional view of the USB interface of FIG. 1.

Referring to FIGS. 1 to 3, a first embodiment of a universal serial bus (USB) interface 10 includes a cover 11, a base 12, a button 13, a bow-shaped elastic piece 14, and signal pins set on the base 12. The signal pins include a positive differential signal pin. The USB interface 10 may be connected to an electronic device (not shown) by a cable 15 electrically connected to the signal pins.

A pair of clamping portions 111 extend down from opposite sides of the cover 11, and a through hole 112 defined in a center of the cover 11. A holding portion 113 is formed on a sidewall bounding the through hole 112.

A pair of clamping grooves 123, defined in opposite sides of the base 12, engage with corresponding clamping portions 111. The positive differential signal pin includes a first section 121 and a second section 122. A receiving room 124 corresponding to the through hole 112 of the cover 11 is defined in a center of the base 12. The elastic piece 14 is set in the receiving room 124. The vaulted portion of the elastic piece 14 resists against a bottom of the second section 122, and two ends of the elastic piece 14 resist against a bottom 1241 of the receiving room 124.

The button 13 includes a driving rod 131. A bulge 132 extends circumferentially from a middle portion of the driving rod 131. The driving rod 131 of the button 13 extends through the through hole 112, the holding portion 113 on the side bounding the through hole 112, with the bulge 132 blocked by the holding portion 113, to prevent the driving rod 131 from disengaging from the through hole 112. A distal end of the driving rod 131 is located on the top of the second section 122, to keep the second section 122 clamped between the distal end of the driving rod 131 and the elastic piece 14 and electrically connected to the first section 121.

In use, a USB cable with the USB interface 10 may be used to connect a storage device to a computer. Initially the button 13 is not pressed, the first and second sections 121, 122 of the positive differential signal pin are electrically connected, and the storage device can be accessed by the computer. Once the storage device is ejected from an operating system of the computer, the storage device cannot be detected by the computer even though the storage device is still physically connected to the computer by the USB cable. If the storage device needs to be accessed by the computer again, the button 13 is pressed and then released. When the button 13 is pressed, the driving rod 131 of the button 13 moves the second section 122, the elastic piece 14 is deformed due to pressure from the second section 122, and the second section 122 moves away from the first section 121, thus breaking the connection between the storage device and the computer. When the button 13 is released, the elastic piece 14 restores to the initial state, the second section 122 returns to the initial position by the elastic piece 14 and is electrically connected to the first section 121 again, thus restoring connection between the storage device and the computer.

Figure 4:
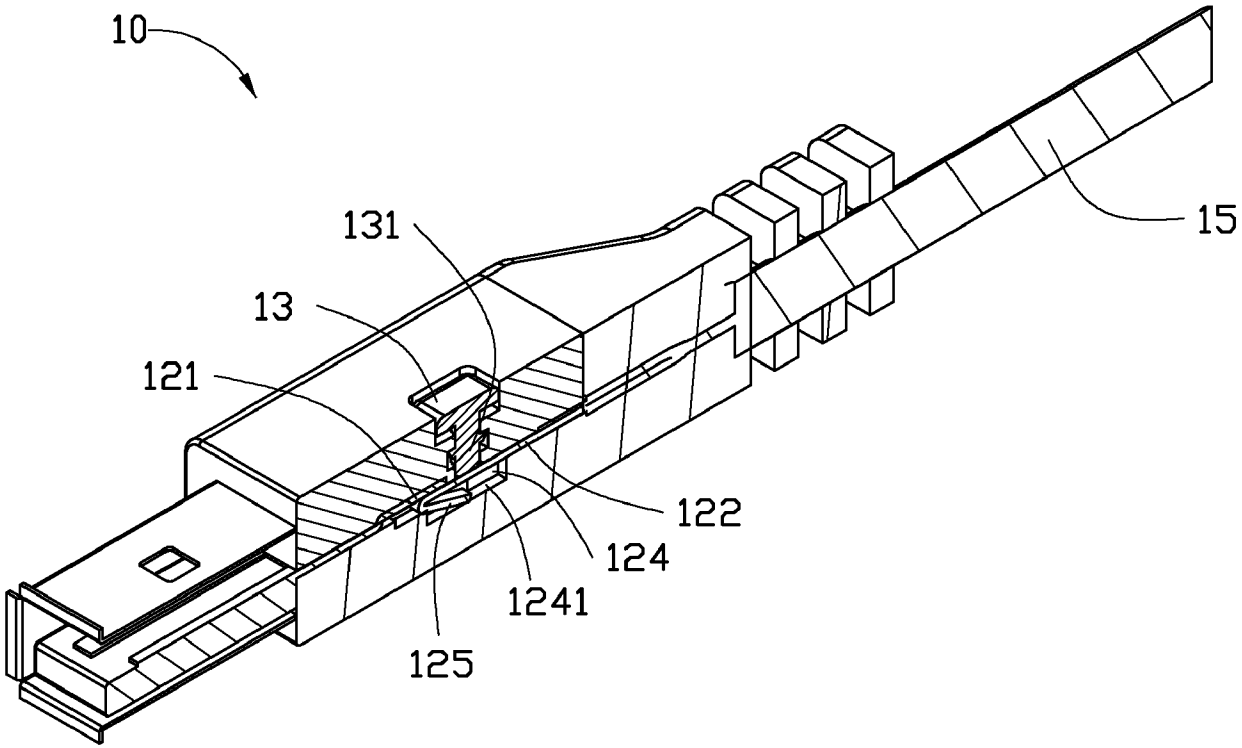
FIG. 4 is a cross-sectional view of a second embodiment of a USB interface.

Referring to FIG. 4, a second embodiment of a USB interface 10 is similar to the first embodiment, except that the elastic piece 14 is replaced with a flexible portion 125 slantingly extending down from the distal end of the second section 122. The distal end of the flexible portion 125 resists against the bottom 1241 of the receiving room 124, to keep the first and second sections 121 and 122 electrically connected. When the button 13 is pressed, the second section 122 moves and deforms the flexible portion 125 due to pressure from the second section 122, and the second section 122 moves away from the first section 121, thus breaking the connection between the storage device and the computer. When the button 13 is released, the flexible portion 125 restores to the initial state, the second section 122 is pushed by the flexible portion 125 to reconnect with the first section 121.

Figure 5:
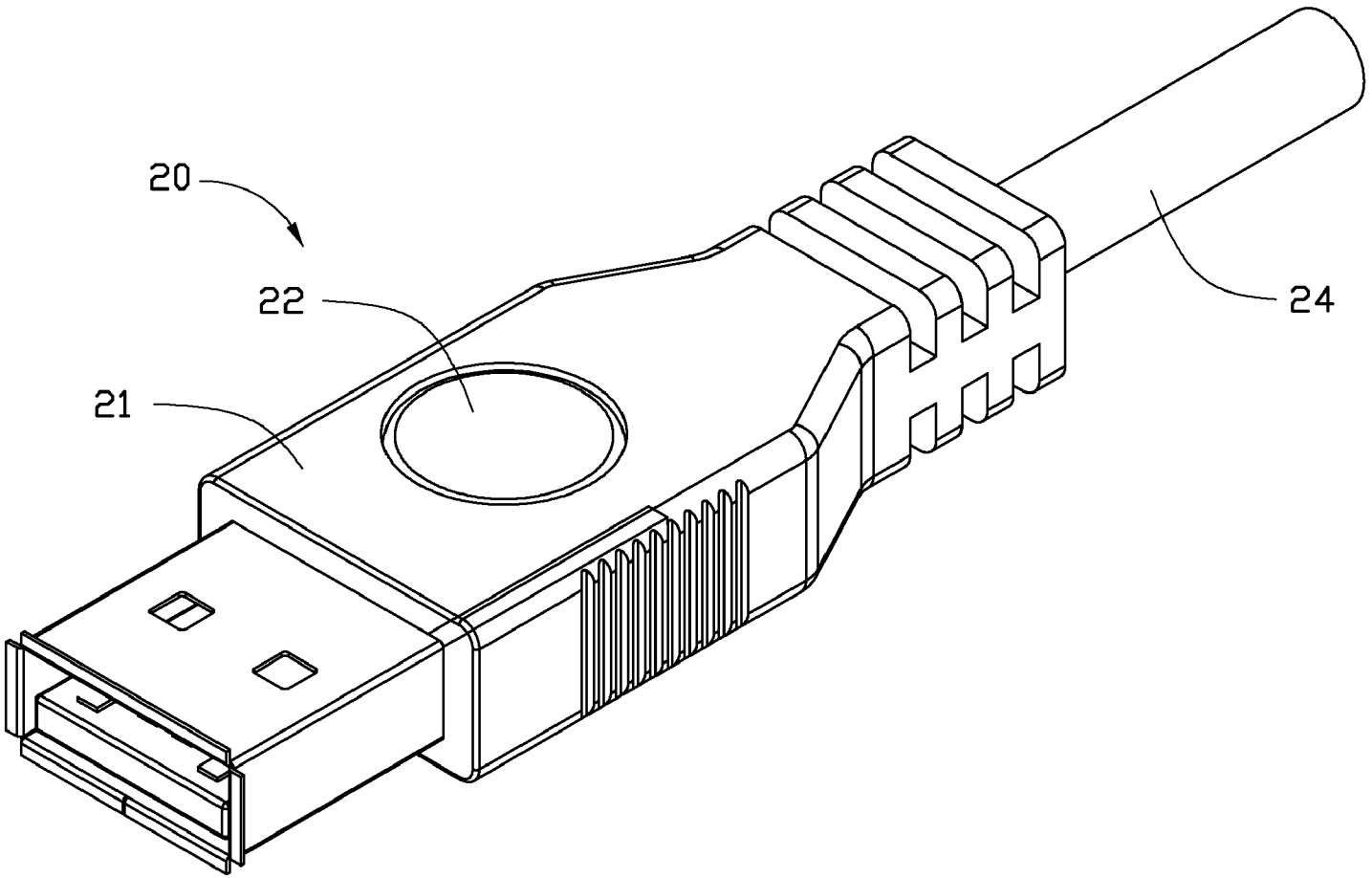
FIG. 5 is an isometric view of a third embodiment of a USB interface.
Figure 6:
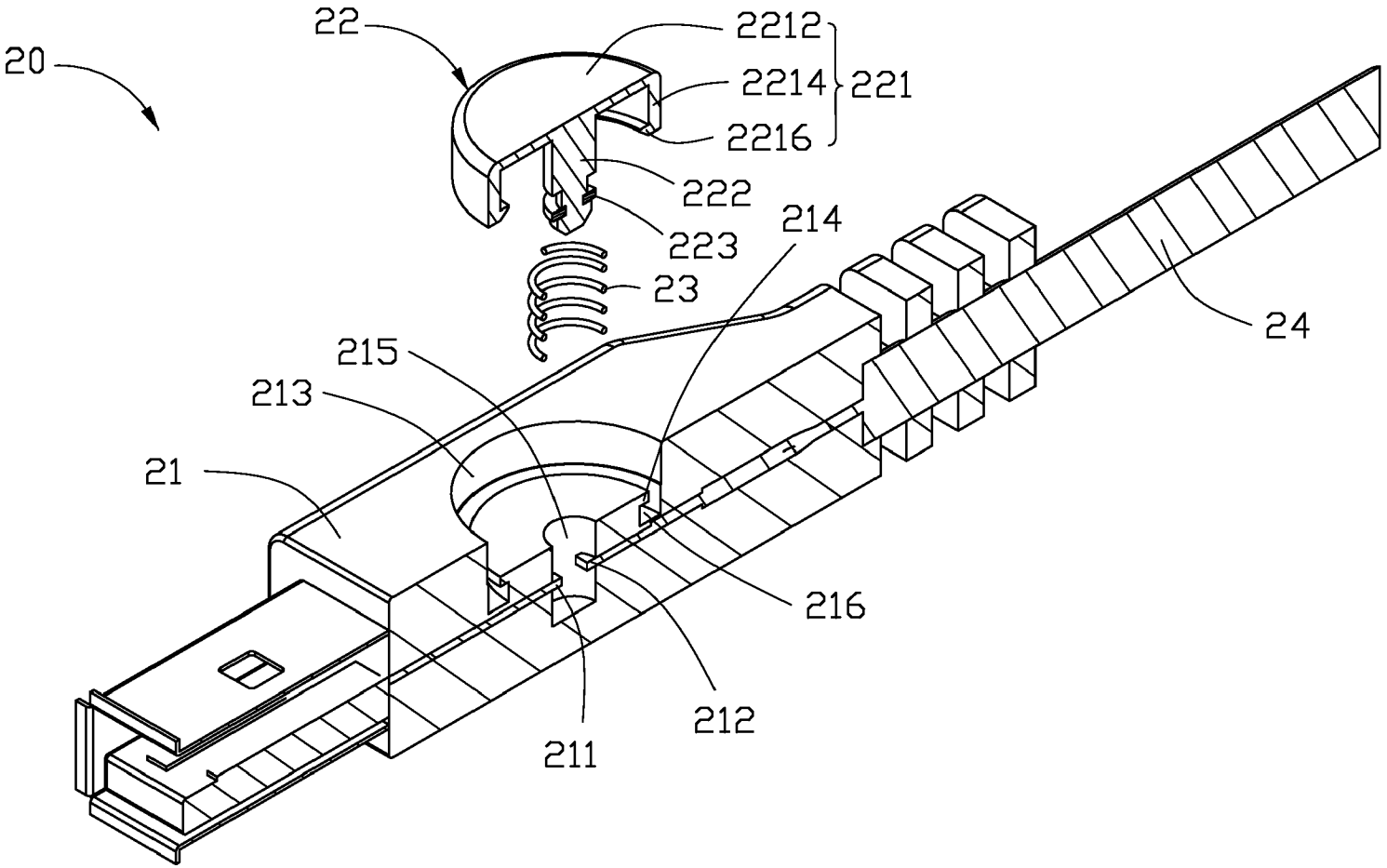
FIG. 6 is a partially exploded, cross-sectional view of the USB interface of FIG. 5.
Figure 7:
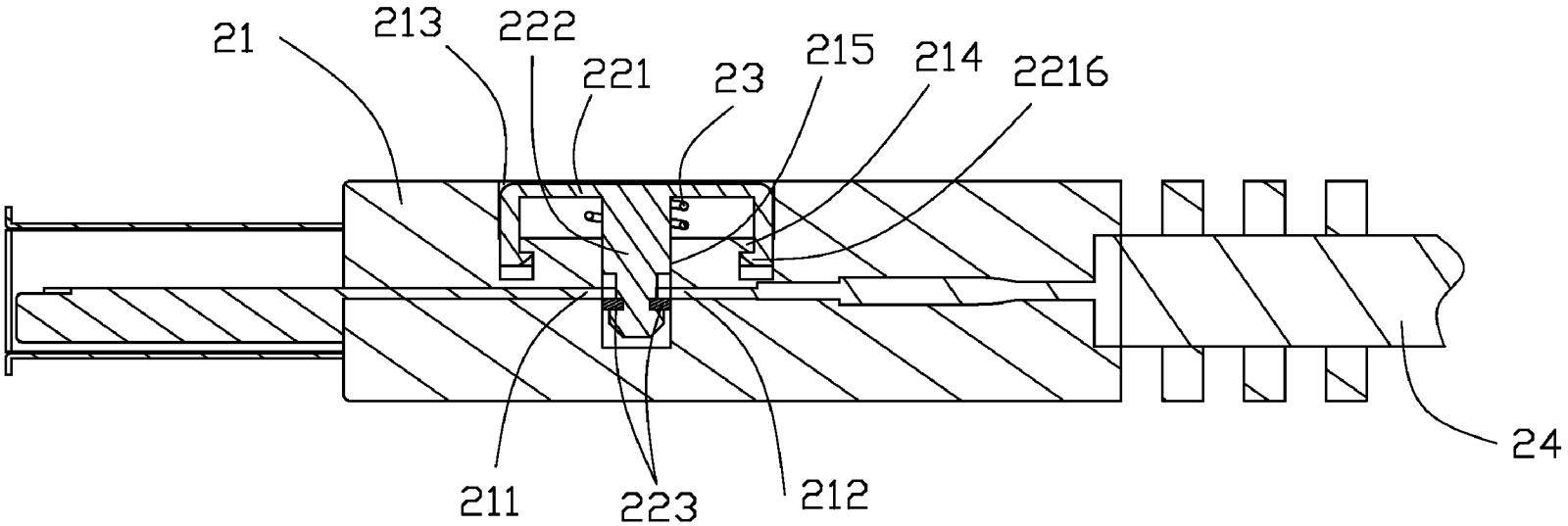
FIG. 7 is an assembled view of FIG. 6, but viewed from another perspective.

Referring to FIGS. 5 to 7, a third embodiment of a USB interface includes a base 21, a button 22, a spring 23, and several signal pins set in the base 21. The signal pins include a positive differential signal pin. The USB interface 10 may be connected to an electronic device (not shown) by a cable 24 electrically connected to the signal pins.

A receiving hole 215 is defined in the base 21. The positive differential signal pin includes a first section 211 and a second section 212. The first and second sections 211, 212 are set on a sidewall bounding the receiving hole 215, opposite to and insulated from each other. A clamping groove 213 is defined in a top of the base 21, communicating with the receiving hole 215. A circular slot 216 is defined in an edge of a bottom of the clamping groove 213, and a holding portion 214 extends from the clamping groove 213 into the slot 216.

The button 22 includes a cap 221 and a driving rod 222 extending down from the cap 221. The cap 221 includes a circular base plate 2212 being perpendicular to the driving rod 222, a side plate 2214 extends substantially perpendicularly down from an edge of the base plate 2212, and a clamping portion 2216 extends from a bottom of the side plate 2214 towards the driving rod 222. The driving rod 222 can be made of insulating material, such as rubber. A conductive ring 223 is set on the driving rod 222 adjacent to a distal end of the driving rod 222. A diameter of the conductive ring 223 is larger than a diameter of the driving rod 222. The driving rod 222 extends through the spring 23 and is partially inserted into the receiving hole 215. The cap 221 is received in the clamping groove 213, with the clamping portion 2216 movably engaged in the slot 216 up and down. The spring 23 is arranged between the cap 221 and the bottom of the clamping groove 213.

In use, a USB cable with the interface 20 may be used to connect a storage device to a computer. When the button 22 is not pressed, the conductive ring 223 is electrically connected to the first and second sections 211, 212, so that the storage device can be accessed by the computer. Once the storage device is ejected by an operating system of the computer, the storage device cannot be detected by the computer even if the storage device is still physically connected to the computer via the USB cable. If the storage device needs to be accessed by the computer again, the button 22 is pressed and then released. When the button 13 is pressed, the spring 23 is compressed, the button 22 moves some distance, and the conductive ring 223 on the driving rod 222 moves from the first and second sections 211, 212. When the button 22 is released, the spring 23 is restored to its initial state and causes the button 22 to move back until the clamping portion 2216 of the cap 221 resists against the holding portion 214, and the conductive ring 223 is electrically reconnected to the first and second sections 211, 212, so that then the storage device may be accessed by the computer again.

Figure 8:
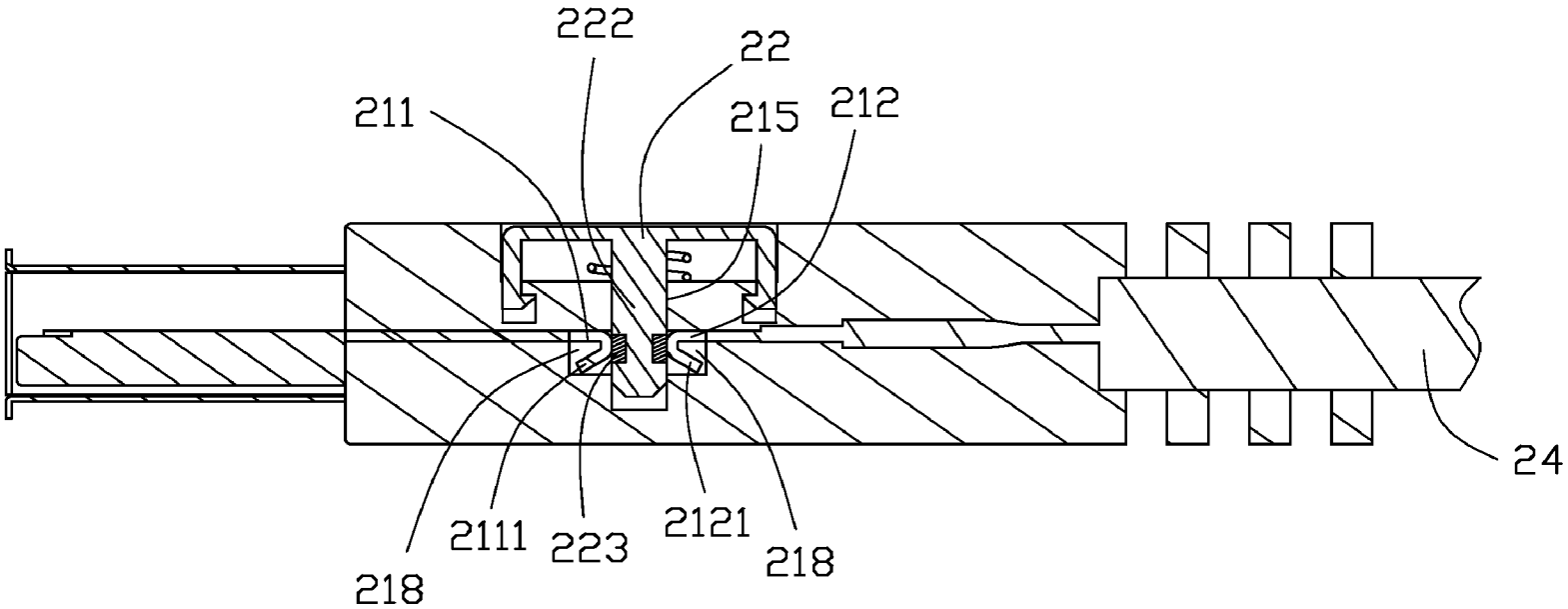
FIG. 8 is a cross-sectional view of a fourth embodiment of a USB interface.

Referring to FIG. 8, a fourth embodiment of a USB interface is substantially similar to the third embodiment, except that the diameter of the conductive ring 223 is substantially equal to the diameter of the driving rod 222, and the two notches 218 are oppositely defined in opposite sides of the receiving hole 215, to receive two curved portions 2111, 2121 respectively extending from distal ends of the first and second sections 211, 212. When the button 22 is not pressed, the conductive ring 223 is electrically connected to the curved portions 2111, 2121. When the button 22 is pressed, the conductive ring 223 may be moved from the curved portions 2111, 2121.

It is to be understood, however, that even though numerous characteristics and advantages of the present disclosure have been set forth in the foregoing description, together with details of the structure and function of the disclosure, the disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. A universal serial bus (USB) interface comprising:

a positive differential signal pin comprising first and second sections; and a button mounted to the USB interface, wherein the button comprises a driving rod having a distal end resisting against the second section; and an elastic piece;

wherein a receiving room is defined below the second section to receive the elastic piece, the second section is clamped between the elastic piece and the driving rod and electrically connected to the first section; when the button is pressed, the driving rod of the button causes the second section to deform the elastic piece, and the second section moves away from the first section; when the button is released, the elastic piece restores to return the first section to the second section, until the first and second sections are electrically connected again.

2. The USB interface of claim 1, wherein the USB interface comprises a base and a cover fastened to the base, the positive differential signal pin is set between the base and the cover, a through hole is defined in the cover through which the driving rod of the button extends, and the receiving room is defined in the base corresponding to the through hole of the cover.

3. The USB interface of claim 2, wherein the elastic piece is bow-shaped, a center of the elastic piece bows to resist against a bottom of the second section, and two ends of the elastic piece resist against a bottom of the receiving room.

4. The USB interface of claim 2, wherein the elastic piece is a flexible portion extending from an end of the second section, and a distal end of the flexible portion resists against the bottom of the receiving room.

5. The USB interface of claim 2, wherein a holding portion is formed on a sidewall bounding the through hole of the cover, a bulge extends from a middle of a circumference of the driving rod, wherein when the button is not pressed, the holding portion resists against the bulge to prevent the driving rod from disengaging from the through hole.

6. The USB interface of claim 2, wherein a pair of clamping portions extend down from opposite sides of the base, a pair of clamping grooves corresponding to the pair of clamping portions are defined in opposite sides of the base, to engage with the pair of clamping portions.

7. A universal serial bus (USB) interface comprising:

a positive differential signal pin comprising first and second sections;

a spring;

a button comprising a cap, and a driving rod extending from the cap, wherein the driving rod is made of insulating material and comprises a conductive portion; and a base defining a receiving hole and a clamping groove communicating with the receiving hole in a top of the base;

wherein the first and second sections of the positive differential signal pin are oppositely set in a sidewall bounding the receiving hole, the driving rod of the button extends through the spring and is engaged in the receiving hole, the spring stays between the cap of the button and the bottom of the clamping groove, the cap of the button is movably accommodated in the clamping groove, the conductive portion is electrically connected to the first and second sections of the positive differential signal pin when the button is not pressed, and the conductive portion of the button moves away from the first and second sections of the positive differential signal pin when the button is pressed.

8. The USB interface of claim 7, wherein the conductive portion is a conductive ring set on the driving rod of the button, and a diameter of the conductive ring is substantially equal to a diameter of the driving rod.

9. The USB interface of claim 8, wherein two curving portions respectively extends from ends of the first and second sections, the conductive ring is electrically connected to the first and second curving portions when the button is not pressed, and the conductive ring moves away from the first and second curving portions when the button is pressed.

10. The USB interface of claim 9, wherein two notches are defined in the sidewall bounding the receiving hole to accommodate the curving portions.

11. The USB interface of claim 7, wherein the cap comprises a base plate being perpendicular to the driving rod, and a side plate extending down from an edge of the base plate.

12. The USB interface of claim 11, wherein a clamping portion extends from a bottom of the side plate towards the driving rod, and a circular slot is defined in a bottom of the clamping groove, to movably engage with the clamping portion.

* * * * *